US005194718A

United States Patent [19]

Reiser et al.

[11] Patent Number: 5,194,718

[45] Date of Patent: Mar. 16, 1993

[54] METHOD FOR CONNECTING A GLOW PLUG FOR OPERATION AT TWO DIFFERENT VOLTAGES

[75] Inventors: Peter Reiser, Esslingen; Herbert Langen, Altbach; Peter Steiner, Esslingen, all of Fed. Rep. of Germany

[73] Assignee: J. Eberspächer, Esslingen, Fed. Rep. of Germany

[21] Appl. No.: 559,387

[22] Filed: Jul. 24, 1990

Related U.S. Application Data

[63] Continuation of Ser. No. 358,548, May 25, 1989, abandoned.

[30] Foreign Application Priority Data

May 25, 1988 [DE] Fed. Rep. of Germany ..... 3817723

[51] Int. Cl.[5] ..... F23Q 7/22; H05B 3/48; F02P 19/02

[52] U.S. Cl. ..... 219/270; 123/145 A; 219/539; 219/544; 219/553; 361/264; 431/43

[58] Field of Search ..... 219/260–270, 219/544, 553, 270, 539; 361/264–266; 123/145 R:145 A; 431/43

[56] References Cited

U.S. PATENT DOCUMENTS

| | | | |
|---|---|---|---|
| 1,590,892 | 6/1926 | Heany | 123/145 A |
| 1,948,974 | 2/1934 | Talmey | 123/145 A |
| 2,229,717 | 1/1941 | Brace et al. | 431/262 |
| 3,296,496 | 1/1967 | Baxter et al. | 219/270 X |
| 3,689,195 | 9/1972 | Beesch et al. | 123/145 A X |
| 4,556,781 | 12/1985 | Bauer | 219/270 |

FOREIGN PATENT DOCUMENTS

| | | | |
|---|---|---|---|
| 648841 | 8/1937 | Fed. Rep. of Germany | 123/145 A |
| 3334038 | 4/1985 | Fed. Rep. of Germany | 219/270 |
| 823513 | 10/1937 | France | 123/145 A |
| 58-210412 | 12/1983 | Japan | 219/270 |
| 62-13930 | 1/1987 | Japan | 219/270 |
| 490530 | 8/1938 | United Kingdom | 123/145 A |

*Primary Examiner*—Anthony Bartis
*Attorney, Agent, or Firm*—McGlew and Tuttle

[57] ABSTRACT

A method for providing uniform thermal output from a glow plug for use in an auxiliary heater of a motor vehicle having either a 12 volt or 24 volt power supply without the use of multiplier resistors utilizes a glow plug having two heating rods having the same electrical resistance and three electrical terminals. One end of the first and second rods are permanently electrically connected respectively to the first and third terminals and the other end of the first and second rods are permanently electrically connected to the second terminal. The vehicle voltage is determined and if the 12 volt supply is present the first and second terminals are connected to the power supply and the first and third terminals are electrically connected to each other to place the heating rods in parallel. If a 24 volt supply is present, the first and third terminals are connected to the power supply with the second terminal left in connected thereby placing the heating rods in series.

1 Claim, 2 Drawing Sheets

Fig. 1
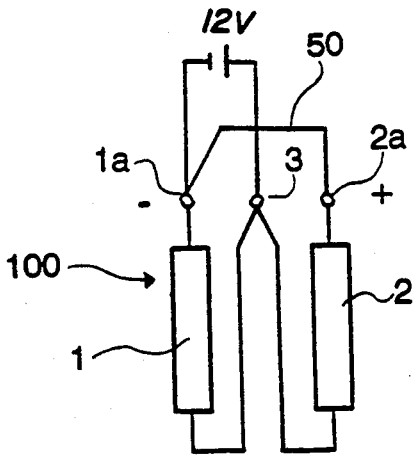
Fig. 2
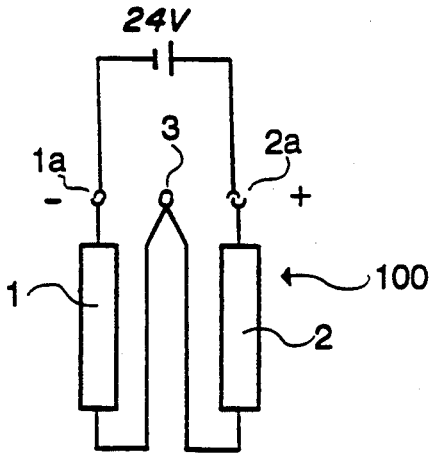
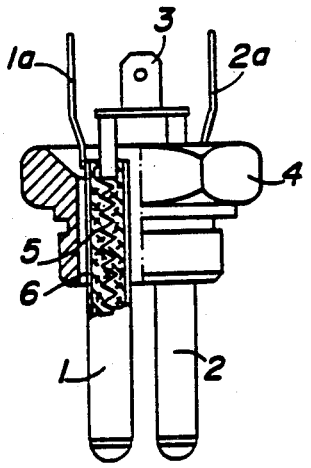
FIG. 3

METHOD FOR CONNECTING A GLOW PLUG FOR OPERATION AT TWO DIFFERENT VOLTAGES

This application is a continuation of application Ser. No. 07/358,548, filed May 25, 1989, now abandoned.

BACKGROUND OF THE INVENTION

Field of the Invention

The invention relates in general to ignition devices and in particular to a new and useful glow plug for motor-independent liquid fuel-fired heaters for motor vehicles and in particular for auxiliary heaters in action when the car is not running as well as for add-on heaters, with a plug base having a heating means on one side and electrical terminals for connection on the other.

In motor vehicles, and, in particular, in trucks and busses, but also in automobiles so-called auxiliary or add-on heaters are installed, which are motor-independent heaters running on e.g. gasoline or diesel fuel. In order to start the heater, i.e. for the ignition of a burner flame, a glow plug is used which is supplied with current just before, or while, air and fuel are supplied to the heater in order to inflame the mixture of air and vaporized gasoline or fuel.

Usually the glow plug is fed by the vehicle battery. The usual glow plugs have a helical wire winding around a rod-shaped carrier having a resistance of only a few ohms but which develops an intense heat when line voltage is applied.

However, the voltage sources for the heaters are different in different motor vehicles. While automobiles usually have a 12 volt battery, the battery voltage in trucks and busses is usually 24 volts. Therefore it was necessary to have two different glow plugs in order to always achieve a certain determined heating output. The stockkeeping of various glow plug types requires undesirable cost and effort, however.

In order to avoid having to stock various glow plug types, it was common to work only with one glow plug, namely with a glow plug for a line voltage of 12 volts. When the heater was installed into a vehicle having a 24 volt battery a multiplier resistor was arranged upstream of the glow plug with the same electrical multiplier resistance value. Due to this a line voltage of 12 volts was achieved at the multiplier resistor as well as at the heating device.

The arrangement of the multiplier resistor, however, required some effort as the same amount of thermal energy generated at the glow plug was also released by the multiplier resistor. In order to divert the heat the multiplier resistor had to be arranged in a place where it did not present a danger for other parts of the vehicle. Other than the space problem the mounting of the multiplier resistor was relatively complicated.

SUMMARY OF THE INVENTION

The invention provides a glow-plug which allows for operation at more than one line voltages without a special multiplier resistor.

According to the invention the heating device includes heating rods, and the electrical terminals for connection are equipped for a choice of a parallel or a series arrangements of a number "n" of heating rods. In a particular embodiment two heating rods are provided which are arranged symmetrically on a circular plug base. Also, four heating rods can be arranged symmetrically, two heating rods each being permanently connected in series.

The arrangement according to the invention allows working without multiplier resistors. The solution for glow plugs is surprisingly simple and offers major advantages. Only one kind of glow plugs has to be stocked. The complicated mounting and arranging of a multiplier resistor is no longer necessary. The elimination of the multiplier resistor increases the operational safety of the whole device. In addition the glow plug saves energy at relatively high line voltage due to the elimination of the multiplier resistor. All of the electrical energy used is transformed into usable heat energy.

In principle the electrical terminals could be similar to a vehicle headlamp, i.e. three electrical terminal points are provided, one each for a heating rod and a common center terminal. The glow plug is used particularly for line voltages of 12 volts or 24 volts. For 12 volts the heating rods are connected in parallel, for 24 volts they are connected in series. The two heating rods preferably have an electrical resistance of 1.2 ohm. This results in an output of about 240 watt per glow plug independent of the line voltage.

The helical wires used in heating devices today have seemingly been regarded as the only way of realizing a heating arrangement. This might be the reason why the solution according to the invention is without any prior art despite major advantages and the extremely simple measures with regard to the electrical connections.

Accordingly, it is an object of the invention to provide a glow-plug for heaters which are selectively operable by electrical sources of different voltages and which comprises a base which has a first side and a opposite second side with at least two heating rods projecting from the second side and a terminal connected to resistance heating wires of the plugs extending from the first side along with a central terminal which is connected to each of the heating elements and in an arrangement on the first side which permits two terminals as well as the central terminal to be selectively connectable in either series or parallel depending on the voltage of the device to which they are connected.

A further object of the invention is to provide a glow-plug which may be operated with a twelve volt battery, a twenty four volt battery and other voltage sources in accordance with the connection and the number of heating elements which are arranged in the glow-plug.

A further object of the invention is to provide a glow-plug which is simple in design rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 1 is a wiring diagram for a glow plug connecting system using a 12 volt source in accordance with the invention;

FIG. 2 is a wiring diagram for the connecting system of the glow plug using a 24 volt source, FIG. 3 is an elevational view, partially in section, of a glow plug with two heating rods.

DETAILED DESCRIPTION OF THE DRAWINGS

Figure 4:
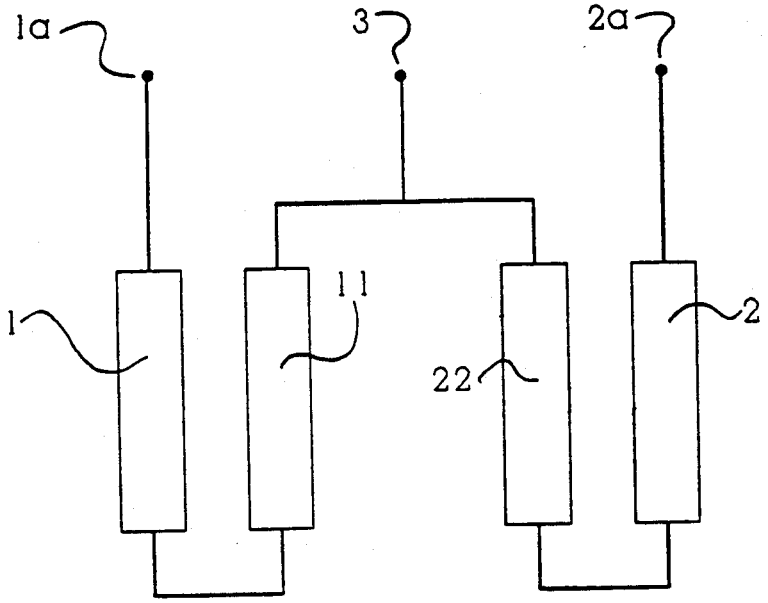
FIG. 4 is a schematic view of a glow plug according to the system of the invention with four heating rods and with sets of two rods permanently connected in series.

The glow plug connecting system according to the invention includes a glow plug generally designated 100 which is used for the ignition of a fuel air mixture in an auxiliary heater of a motor vehicle. If the motor vehicle is an automobile with a 12 volt battery, the glow plug 100 is connected in the manner shown in FIG. 1 to two parallel branches for two heating rods.

With a 24 volt arrangement, e.g. in a truck, two heating rods of the glow plug 100 are connected in series, as is shown in FIG. 2.

FIG. 3 shows the design of the glow plug. A plug base 4 of normal design receives two heating elements in the shape of known heating rods 1 and 2. The heating rods 1 and 2 are arranged symmetrically with regard to the approximately circular side of the plug base facing the combustion chamber. The two heating rods 1, 2 are identical. Each heating rod has an approximately cylindrical, sleeve-shaped body closed at the bottom in which a resistor wire 5 is embedded in a filler 6.

In the upper end of the sleeve body arranged in the plug base there is a first electrical terminal 1*a* which connects to the wire 5 in rod 1. The other heating rod 2 has a respective electrical terminal 2*a* to one end of its resistive wire 5. The other ends of the one end of the resistive wires 5 in the heating rods 1 and 2 have a common center terminal 3.

In a 12 volt device the terminals 1*a* and 2*a* are connected by a bridge means 50 and the supply point is connected to the terminals 1*a* and 3, as is shown in FIG. 1. The current flows parallel through the two resistive wires of the heating rods 1 and 2.

In a 24 volt device the two terminals 1*a* and 2*a* are attached to the binders of the supply voltage while the center terminal 3 remains free. In this case the current flows in series through the resistive wires of heating rods 1 and 2 one after the other.

In a variation of this embodiment four heating rods 1.2, 11, 22 arranged symmetrically on the plug base can be provided instead of the two heating rods 1 and 2. Favorably two heating rods each are connected in series permanently (see FIG. 4). Theoretically 2n (n being a natural number) heating rods could be provided which are wired according to the above basic wiring diagram depending on the line voltage provided.

While specific embodiments of the invention have been shown and described in detail to illustrate the application of the principles of the invention, it will be understood that the invention may be embodied .otherwise without departing from such principles.

What is claimed is:

1. A method for connecting glow plugs for heaters which are selectively capable of being operable on electrical sources of two different voltages wherein the second voltage is twice that of the first, the method comprising the steps in the sequence of:

providing a glow plug structure with a base having a first side and an opposite second side, first and second heating rods projecting from said second side, first, second and third terminals projecting from said first side, said first heating rod having a resistance element with a first end permanently electrically connected to said first terminal and a second end permanently electrically connected to said second terminal, said second heating rod having a resistance element substantially equal to said resistance element of said first heating rod, said resistance element of said second heating rod having a first end permanently electrically connected to said second terminal and a second end permanently electrically connected to said third terminal;

providing an electrical source having either the first lower or the second higher voltage, said higher voltage being twice that of said second voltage, and said electrical source having a pair of terminals;

determining the voltage of the source;

if the source is of the first lower voltage, then electrically connecting the first terminal of the glow plug to the first terminal of the electrical source, electrically connecting said second terminal of the glow plug to the second terminal of the electrical source and electrically connecting said first terminal of the glow plug to said third terminal of the glow plug externally, whereby the heating elements are connected parallel with each other;

if the source is of the second higher voltage, then electrically connecting the first terminal of the glow plug to the first terminal of the source and electrically connecting said third terminal of the glow plug to the second terminal of the source whereby the heating elements being connected in series while leaving the second terminal of the plug unconnected.

* * * * *